US009476576B2

(12) United States Patent
Chen et al.

(10) Patent No.: US 9,476,576 B2
(45) Date of Patent: Oct. 25, 2016

(54) ROTATABLE ILLUMINATION SYSTEM

(71) Applicant: Chunghwa Picture Tubes, LTD., Taoyuan (TW)

(72) Inventors: Yung-Chien Chen, Taoyuan County (TW); Chin-I Chiang, Taipei (TW)

(73) Assignee: Chunghwa Picture Tubes, LTD., Taoyuan (TW)

( * ) Notice: Subject to any disclaimer, the term of this patent is extended or adjusted under 35 U.S.C. 154(b) by 0 days.

(21) Appl. No.: 14/098,537

(22) Filed: Dec. 6, 2013

(65) Prior Publication Data

US 2015/0117008 A1 Apr. 30, 2015

(30) Foreign Application Priority Data

Oct. 24, 2013 (TW) ..... 102138517 A

(51) Int. Cl.

| | |
|---|---|
| ***F21V 21/00*** | (2006.01) |
| ***F21V 21/30*** | (2006.01) |
| ***F21V 23/00*** | (2015.01) |
| *F21S 10/06* | (2006.01) |
| *H01R 39/64* | (2006.01) |
| *F21Y 101/00* | (2016.01) |

(52) U.S. Cl.

CPC ..... *F21V 21/30* (2013.01); *F21V 23/00* (2013.01); *F21S 10/06* (2013.01); *F21Y 2101/00* (2013.01); *H01R 39/64* (2013.01)

(58) Field of Classification Search

CPC ..... F21V 21/30; F21V 21/14; F21V 21/145; F21V 21/15; F21K 9/30; F21Y 2101/02; F21W 2101/00; F21S 10/026; F21S 10/06

USPC ..... 362/249.03, 249.07, 249.1, 372, 418, 362/427; 340/815.83

See application file for complete search history.

(56) References Cited

U.S. PATENT DOCUMENTS 5,584,560 A * 12/1996 Gosswiller et al. .... F21V 21/15 362/233
5,842,768 A * 12/1998 Menke ..... B60Q 1/2611 362/286
7,964,997 B2 6/2011 Son

FOREIGN PATENT DOCUMENTS

| | | |
|---|---|---|
| CN | 2567450 | 8/2003 |
| CN | 2811737 | 8/2006 |
| JP | 59201577 | 11/1984 |
| TW | M399269 | 3/2011 |
| TW | 201317498 | 5/2013 |

OTHER PUBLICATIONS

"Office Action of China Counterpart Application", issued on Jun. 3, 2015, p. 1-p. 5.

* cited by examiner

*Primary Examiner* — Andrew Coughlin
*Assistant Examiner* — Meghan Ulanday
(74) *Attorney, Agent, or Firm* — Jianq Chyun IP Office

(57) ABSTRACT

A rotatable illumination system includes a base and an illumination apparatus. The base includes a first housing, a rotating axis, a first brush and a second brush. The illumination apparatus includes a second housing, at least one light source, and a first electrode set. The second housing includes a bottom portion fixed to the rotating axis. The light source is disposed on the second housing. The first electrode set is disposed on the outer surface of the bottom portion. The first electrode set includes a first outer annular electrode and a first inner annular electrode electrically insulated from the first outer electric disc. The first brush electrically contacts with the first outer annular electrode and the second brush electrically contacts with the first inner annular electrode. The first outer annular electrode and the first inner annular electrode electrically connect with the light source, respectively.

7 Claims, 5 Drawing Sheets

1

ROTATABLE ILLUMINATION SYSTEM

CROSS-REFERENCE TO RELATED APPLICATION

This application claims the priority benefit of Taiwan application serial no. 102138517, filed on Oct. 24, 2013. The entirety of the above-mentioned patent application is hereby incorporated by reference herein and made a part of this specification.

BACKGROUND

1. Field of the Application

The invention relates to an illumination system, and more particularly, to a rotatable illumination system.

2. Description of Related Art

Organic light-emitting diode is a semiconductor element capable of converting electrical energy into light energy and has benefits of high conversion efficiency, self-luminous, high brightness, high contrast and wide viewing angle, and whereby the common applications of the organic light-emitting diode are lighting lamp, advertisement lamp, indicator light, display panel or optical pickup head of light-emitting element and so forth.

Currently, in coordination with the application requirements, an organic light-emitting diode lamp is generally designed to be rotatable so as to provide illumination or display at different orientations/angles. However, in the conventional organic light-emitting diode lamp, the organic light-emitting diode and a light source are connected by wires, so that the general organic light-emitting diode lamp can only rotate at 180 degrees; and if the organic light-emitting diode lamp is to be rotated at unlimited angles and for unlimited number of times, then a problem of poor wire contact or even wire damage due to wire stranding would occur; and this problem has substantially become an immediate issue to be solved.

SUMMARY OF THE APPLICATION

The invention provides a rotatable illumination system capable of rotating at unlimited angles under the normal illuminating condition.

The rotatable illumination system of the invention includes a base and an illumination apparatus. The base includes a first housing, a rotating axis, a first brush and a second brush. The rotating axis is disposed on the first housing. The first brush is disposed on the first housing. The second brush is disposed on the first housing and electrically insulated from the first brush. The illumination apparatus is disposed at a side of the base, and the illumination apparatus includes a second housing, at least one light source and a first electrode set. The second housing includes a bottom portion fixed to the rotating axis. The at least one light source is disposed on the second housing. The first electrode set is disposed on an outer surface of the bottom portion of the second housing. The first electrode set includes a first outer annular electrode and a first inner annular electrode, and the first outer annular electrode is electrically insulated from the first inner annular electrode. The first brush electrically contacts with the first outer annular electrode, the second brush electrically contacts with the first inner annular electrode, and the first outer annular electrode and the first inner annular electrode are electrically connected with the at least one light source, respectively.

In view of foregoing, in the rotatable illumination system provided by the invention, through respectively using the first brush and the second brush to electrically contact with the first outer annular electrode and the first inner annular electrode to transmit the power source, such that the rotatable illumination system can be rotated without restriction while illuminating.

In order to make the aforementioned and other features and advantages of the present application more comprehensible, several embodiments accompanied with figures are described in detail below.

BRIEF DESCRIPTION OF THE DRAWINGS

The accompanying drawings are included to provide a further understanding of the application, and are incorporated in and constitute a part of this specification. The drawings illustrate embodiments of the application and, together with the description, serve to explain the principles of the application.

DETAILED DESCRIPTION OF DISCLOSED EMBODIMENTS

Figure 1:
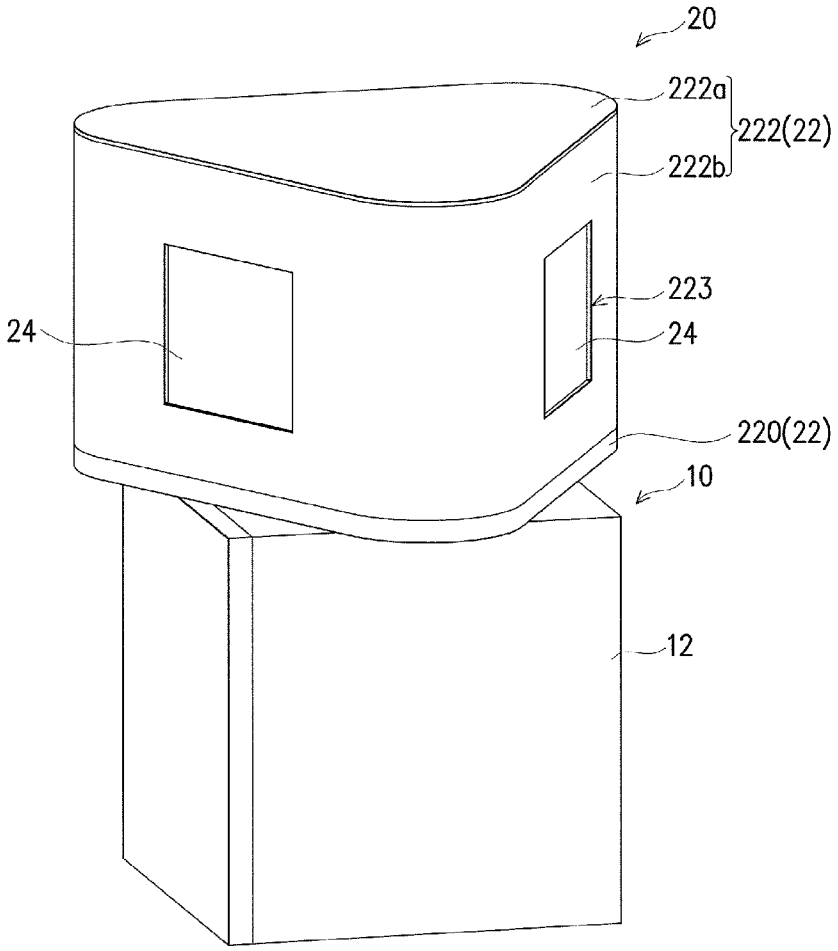
FIG. 1 is schematic three-dimensional view illustrating a rotatable illumination system according to an embodiment of the invention.
Figure 2:
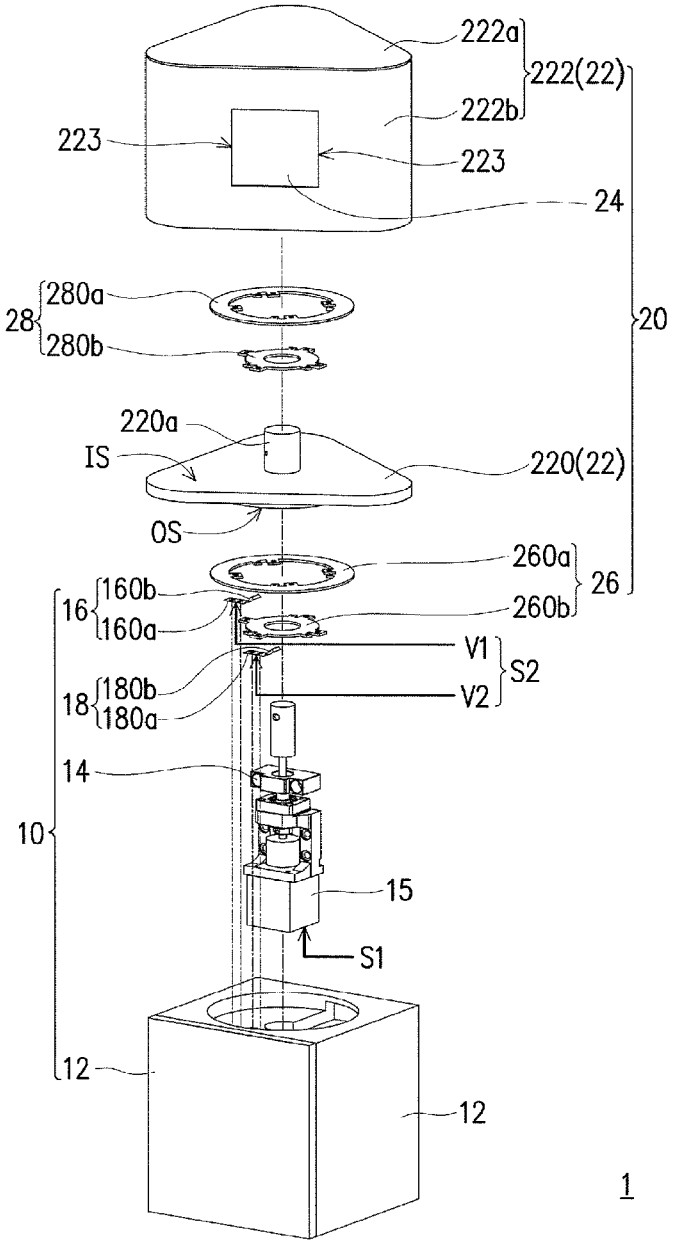
FIG. 2 is a schematic exploded diagram illustrating the rotatable illumination system of FIG. 1.
Figure 3:
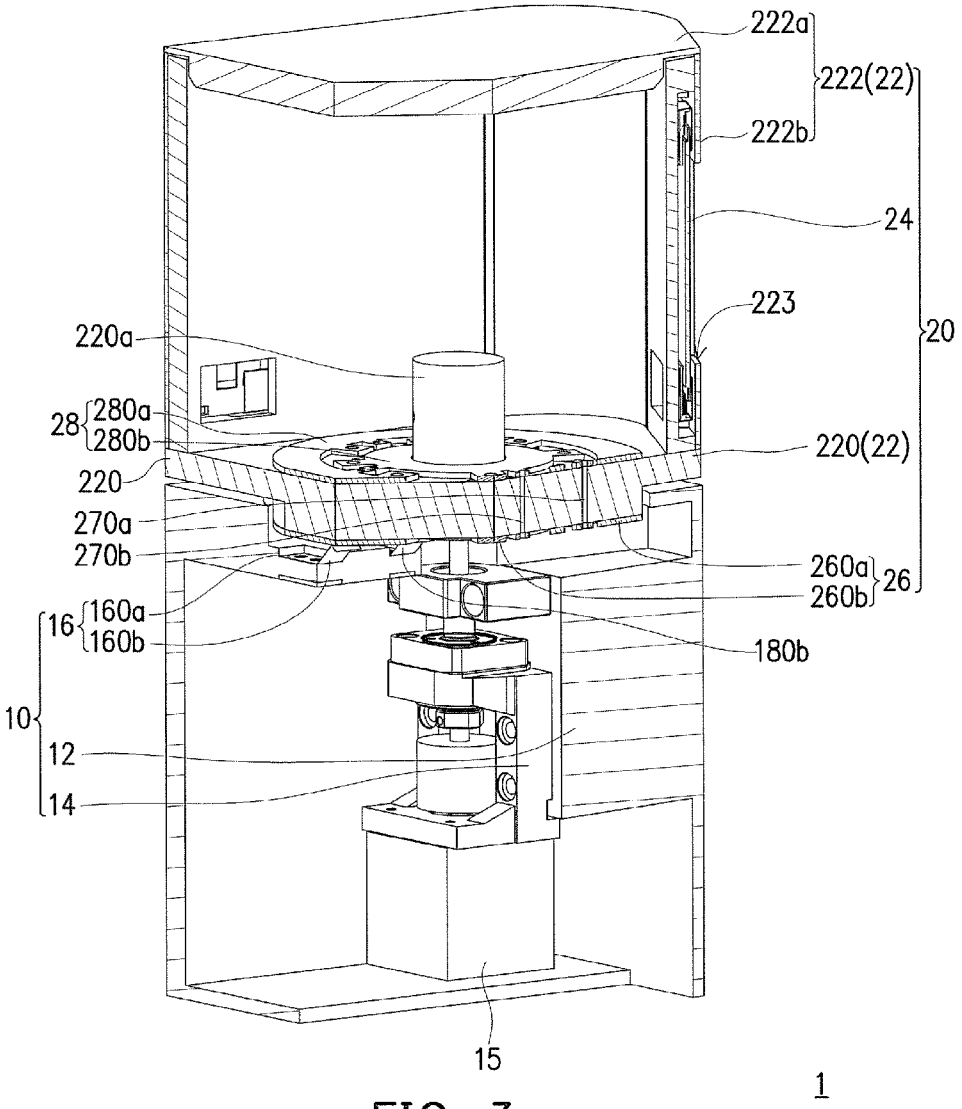
FIG. 3 is a schematic cross-sectional diagram illustrating the rotatable illumination system of FIG. 1.
Figure 4:
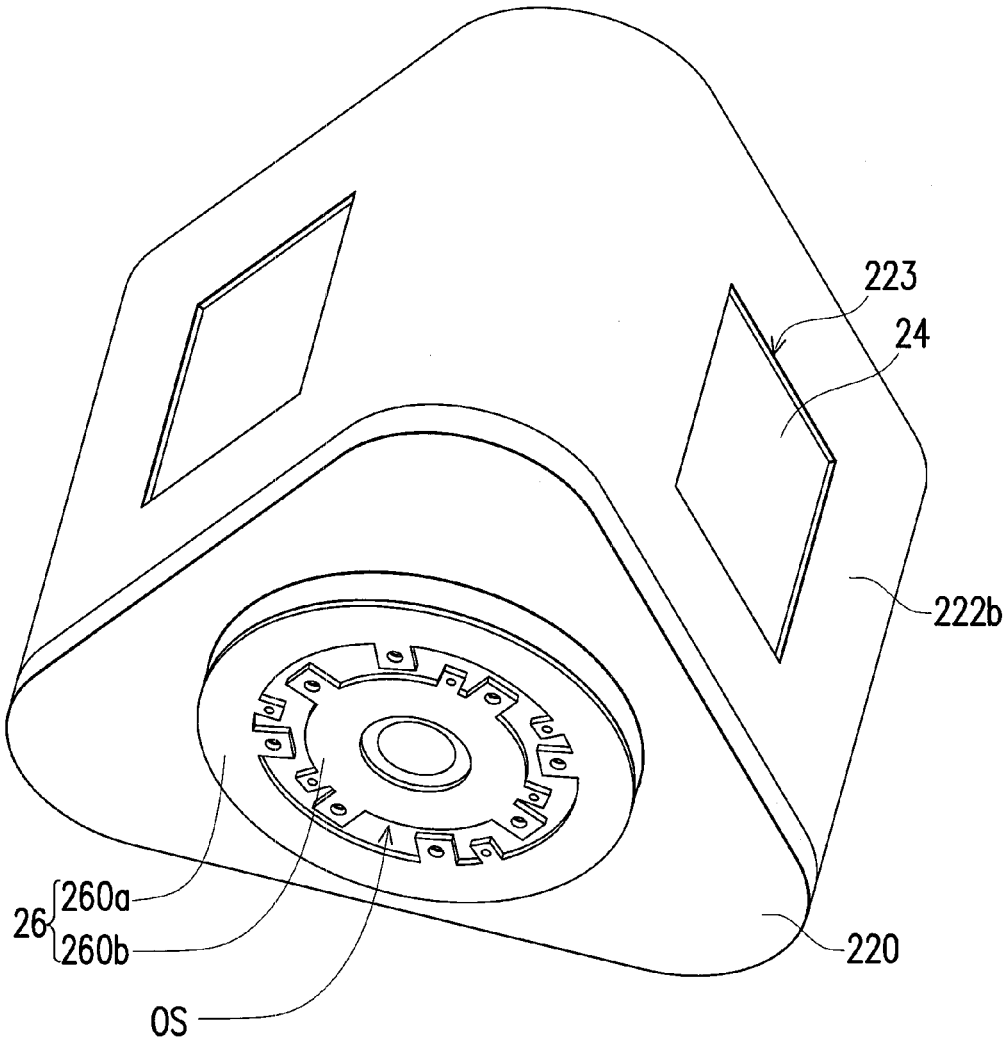
FIG. 4 is a partial schematic three-dimensional view illustrating the rotatable illumination system of FIG. 1.
Figure 5:
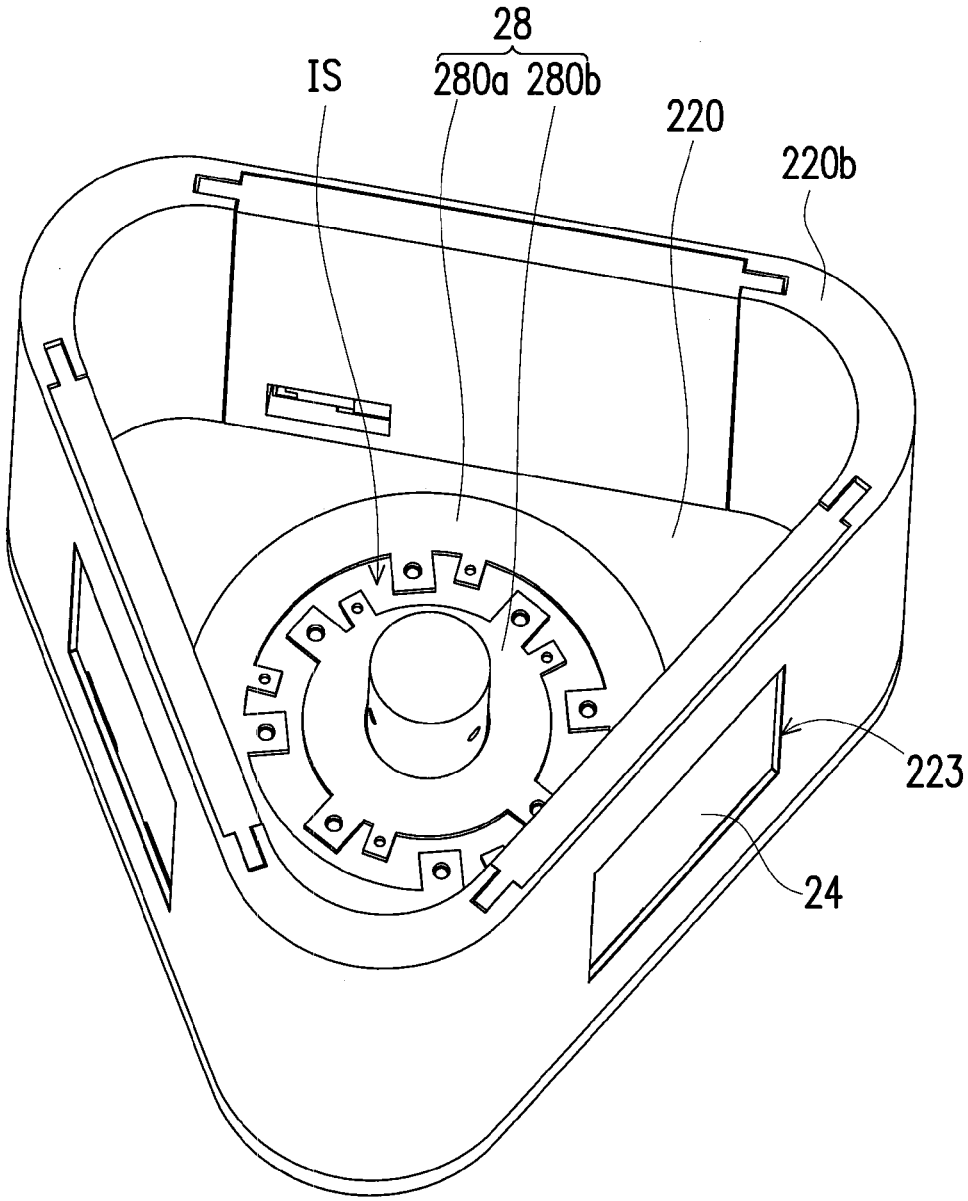
FIG. 5 is another partial schematic three-dimensional view illustrating the rotatable illumination system of FIG. 1.

FIG. 1 is a schematic three-dimensional view illustrating a rotatable illumination system according to an embodiment of the invention. FIG. 2 is a schematic exploded diagram illustrating the rotatable illumination system of FIG. 1. FIG. 3 is a schematic cross-sectional diagram illustrating the rotatable illumination system of FIG. 1. FIG. 4 is a partial schematic three-dimensional view illustrating the rotatable illumination system of FIG. 1. FIG. 5 is another partial schematic three-dimensional view illustrating the rotatable illumination system of FIG. 1.

Referring to FIG. 1, FIG. 2 and FIG. 3 at the same time, a rotatable illumination system 1 includes a base 10 and an illumination apparatus 20. The illumination apparatus 20 is disposed at a side of the base 10. The base 10 includes a first housing 12, a rotating axis 14, a first brush 16 and a second brush 18. The illumination apparatus 20 includes a second housing 22, at least one light source 24 and a first electrode set 26. Detail descriptions regarding each component of the rotatable illumination system 1 are provided in the following below.

The rotating axis 14 is disposed on the first housing 12. The first brush 16 and the second brush 18 are also disposed on the first housing 12, and the first brush 16 is electrically insulated from the second brush 18. In detail, the first brush 16 includes a first end 160*a* and a second end 160*b*, and the second brush 18 includes a first end 180*a* and a second end 180*b*. The first end 160*a* of the first brush 16 and the first end 180*a* of the second brush 18 are respectively fixed on the first housing 12, and the second end 160*b* of the first brush 16 and the second end 180*b* of the second brush 18 are respectively contacting with the first electrode set 26. Moreover, a polarity of the first brush 16 is different from that of the second brush 18. Namely, when the first brush 16 is a positive pole brush, then the second brush 18 is a negative pole brush; contrarily, when the first brush 16 is a negative pole brush, then the second brush 18 is a positive pole brush. In addition, the first brush 16 and the second brush 18 ought to have characteristics such as smooth, wear resistant, good conductivity and so forth; and this is because the second end 160*b* of the first brush 16 and the second end 180*b* of the second brush 18 must be respectively contacting with the first electrode set 26 (relevant descriptions are provided in below). Specifically, a material of the first brush 16 and the second brush 18, for example, is beryllium copper or stainless steel.

In the present embodiment, the rotatable illumination system 1 further includes a rotation driving apparatus 15 electrically coupled to the rotating axis 14 to drive the rotating axis 14 into rotation. The rotation driving apparatus 15 provides the power source for driving the rotating axis 14 into rotation via a rotation power source S1. In one embodiment, the rotation driving apparatus 15 is a motor, and the rotation power source S1 provides 24 Volts of direct current (DC) voltage.

On the other hand, the rotatable illumination system 1 provides a first DC voltage V1 to the first brush 16 and a second DC voltage V2 to the second brush 18 through an illumination power source S2. In detail, the first end 160*a* of the first brush 16 and the first end 180*a* of the second brush 18 are respectively connected to positive and negative electrodes of the illumination power source S2, that is as previously described, the polarity of the first brush 16 is different from that of the second brush 18, and electrical polarity of the first DC voltage V1 is different from that of the second DC voltage V2. It is worthy noting that, in the present embodiment, the illumination power source S2 and the rotation power source S1 are two independent power sources. Namely, while the illumination power source S2 provides the first DC voltage V1 to the first brush 16 and the second DC voltage V2 to the second brush 18, the rotation power source S1 may provide DC voltage to the rotation driving apparatus 15 to drive the rotating axis 14 into rotation, at the same time.

From another point of view, the first DC voltage V1 and the second DC voltage V2 provided by the illumination power source S2 may not be equivalent to the DC voltage provided by the rotation power source S1 to the rotating axis 14. Specifically, in the present embodiment, the first DC voltage V1 is +5 Volts and the second DC voltage V2 is −5 Volts; namely, the first brush 16 is currently the positive pole brush, while the second brush 18 is currently the negative pole brush. However, the invention is not limited thereto. In other embodiments, the first DC voltage V1 may be negative DC voltage, while the second DC voltage V2 is positive DC voltage.

The second housing 22 includes a bottom portion 220, and the second housing 22 is fixed to the rotating axis 14 via the bottom portion 220. In detail, the bottom portion 220 has a protruding portion 220*a* formed thereon, and an end of the rotating axis 14 is fixed inside the protruding portion 220*a*. The illumination apparatus 20 may be driven to rotate by the rotation driving apparatus 15. In the present embodiment, the illumination apparatus 20 may be considered as a movable component, and the first housing 12, the first brush 16 and the second brush 18 in the base 10 may be considered as stationary components.

Moreover, the second housing 22 further includes a lamp chimney 222, and the lamp chimney 222 is connected with the bottom portion 220. In detail, the lamp chimney 222 includes a top portion 222*a* and a sidewall portion 222*b* connecting the top portion 222*a* with the bottom portion 220. In addition, even though an external appearance of the second housing 22 is a triangular prism (as shown in FIG. 1), but the invention is not limited thereto. In other embodiments, based on practical application of the rotatable illumination system, the external appearance of the second housing 22 may also be any polygonal prism, such as a quadrangular prism or a pentagonal prism, or any geometrical shape.

At least one light source 24 is disposed on the second housing 22. In detail, at least one light source 24 is disposed on the sidewall portion 222*b* of the lamp chimney 222, and the sidewall portion 222*b* has at least one opening 223 formed thereon, so that light from at least one light source 24 may be emitted out from the at least one opening 223. The light source 24, for example, is a light-emitting diode, an organic light-emitting diode, a light bulb, or other type of point light source or linear light source. The light source 24 may be a single light source or a plurality of light sources. The invention does not intend to limit the amounts of the light source 24 and the opening 223.

In one embodiment, under the condition that the external appearance of the second housing 22 is the triangular prism (as shown in FIG. 1), three light sources 24 and three openings 223 may correspondingly be disposed on the sidewall portion 222*b*. However, the invention is not limited thereto. As long as the rotatable illumination system is configured with more than one light sources and openings, it is within the scope of the invention. Moreover, even though the light sources 24 are only disposed on the sidewall portion 222*b* of the lamp chimney 222 (as shown in FIG. 1), but the invention is not limited thereto. In other embodiments, the light sources 24 may also be disposed on the top portion 222*a* of the lamp chimney 222. In addition, even though the openings 223 are in shape of squares (as shown in FIG. 1), but the invention is not limited thereto. In the other embodiments, based on the practical application of the rotatable illumination system, the openings 223 may also be any geometric shape.

As shown in FIG. 2 and FIG. 4, the portion 220 of the second housing 22 includes an inner surface IS and an outer surface OS, wherein the outer surface OS faces toward the base 10. The first electrode set 26 is disposed on the outer surface OS of the bottom portion 220 of the second housing 22, so as to face towards the base 10. The first electrode set 26 includes a first outer annular electrode 260*a* and a first inner annular electrode 260*b*, and the first outer annular electrode 260*a* is electrically insulated from the first inner annular electrode 260*b*. A material of the first outer annular electrode 260*a* and the first inner annular electrode 260*b*, for example, is beryllium copper or brass.

Moreover, as shown in FIG. 3 and FIG. 4, the first brush 16 electrically contacts the first outer annular electrode 260*a*, and the second brush 18 electrically contacts the first inner annular electrode 260*b*. In detail, through the direct contact between the second end 160*b* of the first brush 16 and the first outer annular electrode 260*a* and the direct contact between the second end 180*b* of the second brush 18 and the first inner annular electrode 260*b*, the power (viz., the first DC voltage V1 and the second DC voltage V2) provided by the illumination power source S2 may continuously be transmitted to the first outer annular electrode 260*a* and the first inner annular electrode 260*b* through the first brush 16 and the second brush 18 when the rotation power source 15 drives the illumination apparatus 20 into rotation, wherein the first brush 16 and the second brush 18 are stationary components while the first outer annular electrode 260*a* and the first inner annular electrode 260*b* are movable components. In view of this, the first brush 16 and the second brush 18 electrically connected with the first outer annular electrode 260*a* and the first inner annular electrode 260*b* by performing sliding contacts must have characteristics such as smooth, wear resistant and good conductivity, so as to prevent the wearing of the first brush 16 and the second brush 18 to the first outer annular electrode 260*a* and the first inner annular electrode 260*b*, thereby enhancing the reliability and the service life of the rotatable illumination system 1.

From another point of view, since the first brush 16 electrically contacts the first outer annular electrode 260*a* and the second brush 18 electrically contacts the first inner annular electrode 260*b*, then the first outer annular electrode 260*a* is the positive electrode and the first inner annular electrode 260*b* is the negative electrode when the first brush 16 is the positive pole brush and the second brush 18 is the negative pole brush.

In the present embodiment, as shown in FIG. 3 and FIG. 4, the first outer annular electrode 260*a* and the first inner annular electrode 260*b* are coplanar. As a result, the first brush 16 and the second brush 18 contacting with the first outer annular electrode 260*a* and the first inner annular electrode 260*b* are also on the same plane.

Moreover, the first outer annular electrode 260*a* and the first inner annular electrode 260*b* are electrically connected with the light source 24, respectively. As a result, the power (viz., the first DC voltage V1 and the second DC voltage V2) transmitted to the first outer annular electrode 260*a* and the first inner annular electrode 260*b* may provide the power required by the light source 24 to emit the lights. Namely, while the rotation driving apparatus 15 drives the illumination apparatus 20 into rotation, the light source 24 on the illumination apparatus 20 can obtain the required power for providing the illumination at the same time. In further explanation, the transmission of the power required by the light source 24 to illuminate may be transmitted by electrically contacting the second end 160*b* of the first brush 16 with the first outer annular electrode 260*a* and electrically contacting the second end 180*b* of the second brush 18 with the first inner annular electrode 260*b*, and thus no wires are required to be configured to provide power source to the illumination apparatus 20. Hence, the rotatable illumination system 1 of the invention can be rotated at unlimited angles and for unlimited number of times while illuminating, thereby avoiding the problem of causing wire stranding, poor contact or damage in the conventional illumination system due to excessive rotation.

The invention does not intend to limit the meanings on how the first outer annular electrode 260*a* and the first inner annular electrode 260*b* are electrically connected with the light source 24, respectively. In the present embodiment, as shown in FIG. 2, FIG. 3 and FIG. 5, the rotatable illumination system 1 further includes a second electrode set 28 disposed on the inner surface IS of the bottom portion 220 of the second housing 22. The second electrode set 28 includes a second outer annular electrode 280*a* and a second inner annular electrode 280*b*, and the second outer annular electrode 280*a* is electrically insulated from the second inner annular electrode 280*b*. A material of the second outer annular electrode 280*a* and the second inner annular electrode 280*b*, for example, is beryllium copper or brass. Moreover, as shown in FIG. 3 and FIG. 5, the second outer annular electrode 280*a* and the second inner annular electrode 280*b* are coplanar.

In detail, as shown in FIG. 3, the second outer annular electrode 280*a* and the first outer annular electrode 260*a* are correspondingly disposed and electrically connected with each other through a first conductor 270*a*, and the second inner annular electrode 280*b* and the first inner annular electrode 260*b* are also correspondingly disposed and electrically connected with each other through a second conductor 270*b*. The second outer annular electrode 280*a* and the second inner annular electrode 280*b* are electrically connected with the light source 24, respectively. Namely, the first outer annular electrode 260*a* is electrically connected with the light source 24 via the second outer annular electrode 280*a*, and the first inner annular electrode 260*b* is electrically connected with the light source 24 via the second inner annular electrode 280*b*. As a result, the power (viz., the first DC voltage V1 and the second DC voltage V2) transmitted to the first outer annular electrode 260*a* and the first inner annular electrode 260*b* may further be transmitted to the second outer annular electrode 280*a* and the second inner annular electrode 280*b* through the first conductor 270*a* and the second conductor 270*b*, so as to provide the power required by the light source 24 to emit the lights.

In the present embodiment, the first conductor 270*a* and the second conductor 270*b*, for example, are wires or conductor posts, and a forming method thereof includes forming a plurality of through holes in the bottom portion 220 corresponding to the first outer annular electrode 260*a*, the second outer annular electrode 280*a*, the first inner annular electrode 260*b* and the second inner annular electrode 280*b*, and then disposing the wires within the through holes or filling in conducting materials to form the conductor posts. Moreover, the invention does not intend to limit the meaning on how the second outer annular electrode 280*a* and the second inner annular electrode 280*b* are electrically connected with the light source 24, respectively. For example, the second outer annular electrode 280*a* and the second inner annular electrode 280*b* may be electrically connected with the light source 24, respectively through the wires, electrical spring plates or other suitable methods.

In summary, in the rotatable illumination system provided in the above embodiments, the illumination power source for providing power to the light source and the rotation power source for driving the rotation are two independent power sources, and transmit the power required by the light source to emit the lights by electrically contacting the coplanarly disposed first outer annular electrode and first inner annular electrode respectively with the coplanarly disposed first brush and second brush, so that the rotatable illumination system can be rotated without restriction while illuminating. In addition, the rotatable illumination system provided by the invention may be applied to a variety of mood lightings, digital advertisings or digital illuminations.

What is claimed is:

1. A rotatable illumination system, comprising:

a base, comprising:

a first housing;

a rotating axis disposed on the first housing;

a first brush disposed on the first housing; and a second brush disposed on the first housing and electrically insulated from the first brush; and an illumination apparatus disposed at a side of the base, the illumination apparatus comprising:

a second housing comprising a bottom portion, the bottom portion fixed to the rotating axis;

at least one light source disposed on the second housing; and a first electrode set disposed on an outer surface of the bottom portion of the second housing, the first electrode set comprising a first outer annular electrode and a first inner annular electrode, and the first outer annular electrode and the first inner annular electrode being electrically insulated from each other, wherein the first brush electrically contacts with the first outer annular electrode, the second brush electrically contacts with the first inner annular electrode, the first outer annular electrode and the first inner annular electrode are electrically connected with the at least one light source, respectively, and a polarity of the first brush is different from that of the second brush, and wherein the rotatable illumination system further comprises a rotation driving apparatus electrically coupled to the rotating axis to drive the rotating axis, the first brush and the second brush are electrically coupled to an illumination power source, the illumination power source provides a first DC voltage to the first brush and a second DC voltage to the second brush, the rotation driving apparatus is electrically coupled to the rotation power source, and the illumination power source and the rotation power source are two independent power sources.

2. The rotatable illumination system as recited in claim 1, further comprising a second electrode set disposed on an inner surface of the bottom portion of the second housing, the second electrode set comprising a second outer annular electrode and a second inner annular electrode, and the second outer annular electrode and the second inner annular electrode being electrically insulated from each other.

3. The rotatable illumination system as recited in claim 2, wherein the first outer annular electrode and the second outer annular electrode are correspondingly disposed and electrically connected with each other via a first conductor, the first inner annular electrode and the second inner annular electrode are correspondingly disposed and electrically connected with each other via a second conductor, and the second outer annular electrode and the second inner annular electrode are electrically connected with the at least one light source, respectively.

4. The rotatable illumination system as recited in claim 3, wherein the first outer annular electrode is electrically connected with the at least one light source via the second outer annular electrode, and the first inner annular electrode is electrically connected with the at least one light source via the second inner annular electrode.

5. The rotatable illumination system as recited in claim 2, wherein the first outer annular electrode and the first inner annular electrode are coplanar, and the second outer annular electrode and the second inner annular electrode are coplanar.

6. The rotatable illumination system as recited in claim 1, wherein the at least one light source comprises a light-emitting diode or an organic light-emitting diode.

7. The rotatable illumination system as recited in claim 1, wherein the second housing further comprises a lamp chimney, the lamp chimney is connected with the bottom portion, and the at least one light source is disposed on the lamp chimney of the second housing.

* * * * *